US007992867B2

(12) United States Patent
Okamoto et al.

(10) Patent No.: US 7,992,867 B2
(45) Date of Patent: Aug. 9, 2011

(54) SHEET PROCESSING APPARATUS AND IMAGE FORMING APPARATUS

(75) Inventors: Kouji Okamoto, Misato (JP); Atsushi Takada, Abiko (JP)

(73) Assignee: Canon Finetech Inc., Misato-shi (JP)

( * ) Notice: Subject to any disclaimer, the term of this patent is extended or adjusted under 35 U.S.C. 154(b) by 121 days.

(21) Appl. No.: 12/369,262

(22) Filed: Feb. 11, 2009

(65) Prior Publication Data

US 2009/0212487 A1 Aug. 27, 2009

(30) Foreign Application Priority Data

Feb. 25, 2008 (JP) ..... 2008-043633

(51) Int. Cl.
*B65H 9/16* (2006.01)

(52) U.S. Cl. ..... 271/250; 271/248; 271/249; 271/220; 271/221; 270/58.12; 270/58.27; 270/58.17

(58) Field of Classification Search ..... 271/250, 271/248, 249, 220, 221; 270/58.12, 58.17, 270/58.27

See application file for complete search history.

(56) References Cited

U.S. PATENT DOCUMENTS

| | | | | |
|---|---|---|---|---|
| 6,219,503 | B1 | 4/2001 | Miyake et al. | 399/85 |
| 6,273,418 | B1 * | 8/2001 | Fujikura et al. | 271/228 |
| 6,330,422 | B1 | 12/2001 | Sato et al. | 399/382 |
| 6,386,080 | B1 | 5/2002 | Okamoto et al. | 83/73 |
| 7,073,706 | B2 | 7/2006 | Yaginuma et al. | 234/97 |
| 7,080,835 | B2 | 7/2006 | Oikawa et al. | 271/208 |
| 7,300,046 | B2 | 11/2007 | Sugiyama et al. | 270/58.17 |
| 7,354,034 | B2 | 4/2008 | Nakamura et al. | 270/58.1 |
| 7,392,983 | B2 * | 7/2008 | Kodama et al. | 271/249 |
| 7,566,051 | B2 * | 7/2009 | Kodama et al. | 270/58.12 |
| 7,571,909 | B2 * | 8/2009 | Saeki et al. | 271/292 |
| 7,665,730 | B2 * | 2/2010 | Funada | 271/250 |

FOREIGN PATENT DOCUMENTS

JP 2005-306506 11/2005

* cited by examiner

*Primary Examiner* — Stefanos Karmis
*Assistant Examiner* — Luis Gonzalez
(74) *Attorney, Agent, or Firm* — Fitzpatrick, Cella, Harper & Scinto

(57) ABSTRACT

A sheet processing apparatus of the invention has: a movement blocking unit for blocking a movement of a sheet which is moved to a side edge aligning unit by a moving unit, thereby allowing the moving unit to position adjustment slip move on the sheet so as to adjust a relative position with the sheet; and a block cancelling unit for allowing the movement blocking unit to cancel the block of the movement of the sheet when the moving unit slips and moves by a predetermined distance.

8 Claims, 16 Drawing Sheets

SHEET PROCESSING APPARATUS AND IMAGE FORMING APPARATUS

BACKGROUND OF THE INVENTION

1. Field of the Invention

The present invention relates to a sheet processing apparatus for aligning a side edge of a sheet and to an image forming apparatus having the sheet processing apparatus in an apparatus main body.

2. Description of the Related Art

Hitherto, as an image forming apparatus for forming an image onto a sheet, there is a type in which a sheet processing apparatus for aligning a sheet side edge along a sheet conveying direction is provided for an apparatus main body (the Official Gazette of Japanese Patent Application Laid-Open No. 2005-306506).

Schematic diagrams of a sheet processing apparatus in the related art are illustrated in FIGS. 16A to 16C and 17A to 17C. The sheet processing apparatus has a processing roller 204 as a moving unit. The processing roller 204 is brought into contact with an upper surface Sb of a sheet S stacked on a processing tray 205 as a stacking unit so that the processing roller can slip and is moved in a sheet width direction (direction illustrated by an arrow) which crosses a sheet ejecting direction. While moving in the arrow direction, the processing roller 204 moves the sheet in the arrow direction so that a side edge Sa of the sheet S is come into contact with a width restricting plate 239 as a side edge aligning unit, thereby making a side edge alignment of the sheet. The side edge Sa of the sheet S indicates a sheet edge along the sheet conveying direction.

When the side edge alignment of the sheet is made, the processing roller 204 slip-moves (slips) on the sheet in a state where the side edge Sa of the sheet S is in contact with the width restricting plate 239 and causes a deflection in the side edge portion of the sheet, thereby raising side edge aligning precision of the sheet.

The sheet processing apparatus in the related art uses what is called a center-main conveyance in which the sheet is conveyed in a state where a center in the width direction of the sheet and a center in the width direction of a sheet conveying path are made coincident. A center (CL1) in the width direction of the processing roller 204 existing at a home position also coincides with a center (CL2) in the width direction of the sheet.

Therefore, a distance (L2) between the side edge Sa of the sheet having a large width size in FIGS. 17A to 17C and an edge surface 204*a* of the processing roller 204 is longer than a distance (L1) between the side edge Sa of the sheet having a small width size in FIGS. 16A to 16C and the edge surface 204*a* of the processing roller 204.

A distance (L8) at which the processing roller 204 moves from the center (CL2) in the width direction of the sheet to a position where the processing roller 204 finishes the side edge alignment of the sheet and stops, is set to a predetermined value irrespective of the width size (length in the arrow direction) of the sheet. Therefore, an interval (L5) between the processing roller 204 and the width restricting plate 239 at the time when the processing roller 204 finishes the side edge alignment of the sheet and stops, is constant irrespective of the width size of the sheet.

Consequently, in the case of the sheet having the large width size, a distance at which the processing roller 204 further moves (alignment slip movement) after the processing roller 204 makes the side edge Sa of the sheet hit to the width restricting plate 239 is equal to L2−L5 (=L7). In the case of the sheet having the small width size, a distance at which the processing roller 204 further moves (alignment slip movement) after the processing roller 204 made the side edge Sa of the sheet hit to the width restricting plate 239 is equal to L1−L5 (=L6). Since L2>L1, L7>L6.

That is, the alignment slip movement distance of the processing roller 204 in the case of the sheet having the large width size is larger than that of the sheet having the small width size.

SUMMARY OF THE INVENTION

As mentioned above, in the sheet processing apparatus in the related art, by the processing roller 204 in which the movement distance (L8) in the width direction of the sheet is constant, the sheet conveyed by the center-main conveyance is moved by the same distance (L8) as a movement distance of a processing tray. Therefore, the relation of (L2>L1) occurs and in the case of the sheet having the large width size, a deflection amount of the sheet at the time when the sheet side edge has been come into contact with the width restricting plate 239 is larger than that of the sheet having the small width size and a buckling of the sheet is liable to occur.

The above problem occurs not only in the sheet processing apparatus of the center-main conveyance but also, similarly, in a sheet processing apparatus in which the sheet is away from a side wall of a sheet conveying path and conveyed.

In other words, the above problem occurs in the sheet processing apparatus in which the sheet stacked on the processing tray so as to be away from the width restricting plate 239 is moved by the same distance as the movement distance (L8) by the processing roller 204 in which the movement distance (L8) in the width direction of the sheet is constant, thereby making the side edge alignment.

In an image forming apparatus having the sheet processing apparatus in which buckling is caused in the sheet, there is a case where an image has to be formed again on the buckled sheet and image forming efficiency is low.

The invention intends to provide a sheet processing apparatus in which a frequency of occurrence of the buckling in a sheet received to a side edge aligning unit is reduced.

The invention intends to provide an image forming apparatus in which the sheet processing apparatus is provided for an apparatus main body, where an image is formed again on a sheet and an amount of the occurrence of the buckling is reduced, so that image forming efficiency is improved.

According to the invention, there is provided a sheet processing apparatus comprising: a stacking unit on which an ejected sheet is stacked; a moving unit which is come into contact with an upper surface of the sheet stacked on the stacking unit so that the moving unit can slip and moves the sheet in a direction which crosses a sheet ejecting direction; and a side edge aligning unit adapted to receive a side edge along the sheet ejecting direction of the sheet which is moved in the crossing direction by the moving unit, wherein the moving unit further moves in a state where the sheet stacked on the stacking unit so as to be away from the side edge aligning unit has been moved to and has been come into contact with the side edge aligning unit, and the sheet processing apparatus further includes a movement blocking unit adapted to block the movement of the sheet which is moved to the side edge aligning unit by the moving unit, thereby allowing the moving unit to slip and move on the sheet so as to adjust a relative position with the sheet and a block cancelling unit adapted to allow the movement blocking unit to cancel the block of the movement of the sheet when the moving unit has position adjustment slip moved by a predetermined distance.

According to the invention, there is also provided a sheet processing apparatus comprising: a stacking unit on which an ejected sheet is stacked; a moving unit which is come into contact with an upper surface of the sheet stacked on the stacking unit so that the moving unit can slip and moves the sheet in a direction which crosses a sheet ejecting direction; and a side edge aligning unit which receives a side edge along the sheet ejecting direction of the sheet which is moved in the crossing direction by the moving unit, wherein the moving unit further moves in a state where the sheet stacked on the stacking unit so as to be away from the side edge aligning unit has been moved to and has been come into contact with the side edge aligning unit, the sheet processing apparatus further includes a movement blocking unit which blocks the movement of the sheet which is moved to the side edge aligning unit by the moving unit, thereby allowing the moving unit to slip and move on the sheet so as to adjust a relative position with the sheet and a block cancelling unit adapted to allow the movement blocking unit to cancel the block of the movement of the sheet, and the block cancelling unit calculates a position adjustment slip movement distance from a slip start position of the moving unit to a slip end position as a position away from the side edge of the sheet based on information of the sheet, and when the moving unit slips and moves by the position adjustment slip movement distance, the block cancelling unit allows the movement blocking unit to cancel the block of the movement of the sheet.

According to the invention, there is also provided an image forming apparatus comprising: an image forming unit which forms an image onto a sheet; and a sheet processing apparatus which aligns a side edge of the sheet on which the image has been formed by the image forming unit, wherein the sheet processing apparatus is one of the foregoing sheet processing apparatuses.

According to the sheet processing apparatus of the invention, the sheet is made to come into contact with the side edge aligning unit by the moving unit, the movement of the sheet is blocked by the movement blocking unit, and when the moving unit slips and moves on the upper surface of the sheet, a distance between the side edge of the sheet and the moving unit is shortened. Thus, the sheet processing apparatus of the invention can reduce a frequency of occurrence of the buckling of the sheet that is caused when the sheet is made to come into contact with the side edge aligning unit and can improve the side edge aligning precision of the sheet.

Since the image forming apparatus of the invention has the sheet processing apparatus in which the frequency of occurrence the buckling of the sheet is reduced, such a situation that the image is formed again on the sheet corresponding to the amount of the occurrence of the buckling is reduced and the image forming efficiency can be improved.

Further features of the present invention will become apparent from the following description of exemplary embodiments with reference to the attached drawings.

BRIEF DESCRIPTION OF THE DRAWINGS

FIGS. 9A, 9B, 9C and 9D are diagrams for describing the operation at the time when the processing roller is slipped on the sheet and the side edge alignment of the sheet is made, in which FIG. 9A is a diagram illustrating a state where the side edge alignment of the sheet is started, FIG. 9B is a diagram illustrating a state where the processing roller has been slipped and moved for a position alignment, FIG. 9C is a diagram illustrating a state where the side edge of the sheet has been come into contact with a width restricting plate, and FIG. 9D is a diagram illustrating a state where the processing roller has been slipped moved for an alignment.

FIGS. 10A, 10B, 10C and 10D are diagrams for describing the operation at the time when a processing roller is slipped on a sheet having a small width size and the side edge alignment of the sheet is made in a sheet processing apparatus according to another embodiment, in which FIG. 10A is a diagram illustrating a state where the side edge alignment of the sheet is started, FIG. 10B is a diagram illustrating a state where the processing roller has been slipped and moved for a position alignment, FIG. 10C is a diagram illustrating a state where the side edge of the sheet has been come into contact with a width restricting plate, and FIG. 10D is a diagram illustrating a state where the processing roller has been slipped and moved for an alignment.

FIGS. 11A, 11B, 11C and 11D are diagrams for describing the operation at the time when a processing roller is slipped on a sheet having a large width size and the side edge alignment of the sheet is made in a sheet processing apparatus according to further another embodiment, in which FIG. 11A is a diagram illustrating a state where the side edge alignment of the sheet is started, FIG. 11B is a diagram illustrating a state where the processing roller has been slipped and moved for a position alignment, FIG. 11C is a diagram illustrating a state where the side edge of the sheet has been come into contact with a width restricting plate, and FIG. 11D is a diagram illustrating a state where the processing roller has been slipped and moved for an alignment.

FIGS. 16A, 16B and 16C are diagrams for describing the operation at the time when a processing roller is slipped on a sheet having a small width size and the side edge alignment of the sheet is made in a sheet processing apparatus in the related art, in which FIG. 16A is a diagram illustrating a state where the side edge alignment of the sheet is started, FIG. 16B is a diagram illustrating a state where the processing roller has been slipped and moved for a position alignment, and FIG. 16C is a diagram illustrating a state where the processing roller has allowed the side edge of the sheet to be come into contact with a width restricting plate and has been slipped and moved for an alignment.

FIGS. 17A, 17B and 17C are diagrams for describing the operation at the time when, in the sheet processing apparatus in the related art, the processing roller is slipped on a sheet having a large width size and the side edge alignment of the sheet is made, in which FIG. 17A is a diagram illustrating a state where the side edge alignment of the sheet is started, FIG. 17B is a diagram illustrating a state where the processing roller has been slipped and moved for a position alignment, and FIG. 17C is a diagram illustrating a state where the processing roller has allowed the side edge of the sheet to be come into contact with the width restricting plate and has been slipped and moved for an alignment.

DESCRIPTION OF THE EMBODIMENTS

A sheet processing apparatus of an embodiment of the invention and an image forming apparatus in which the sheet processing apparatus has been provided for an apparatus main body will be described hereinbelow with reference to the drawings.

Figure 1:
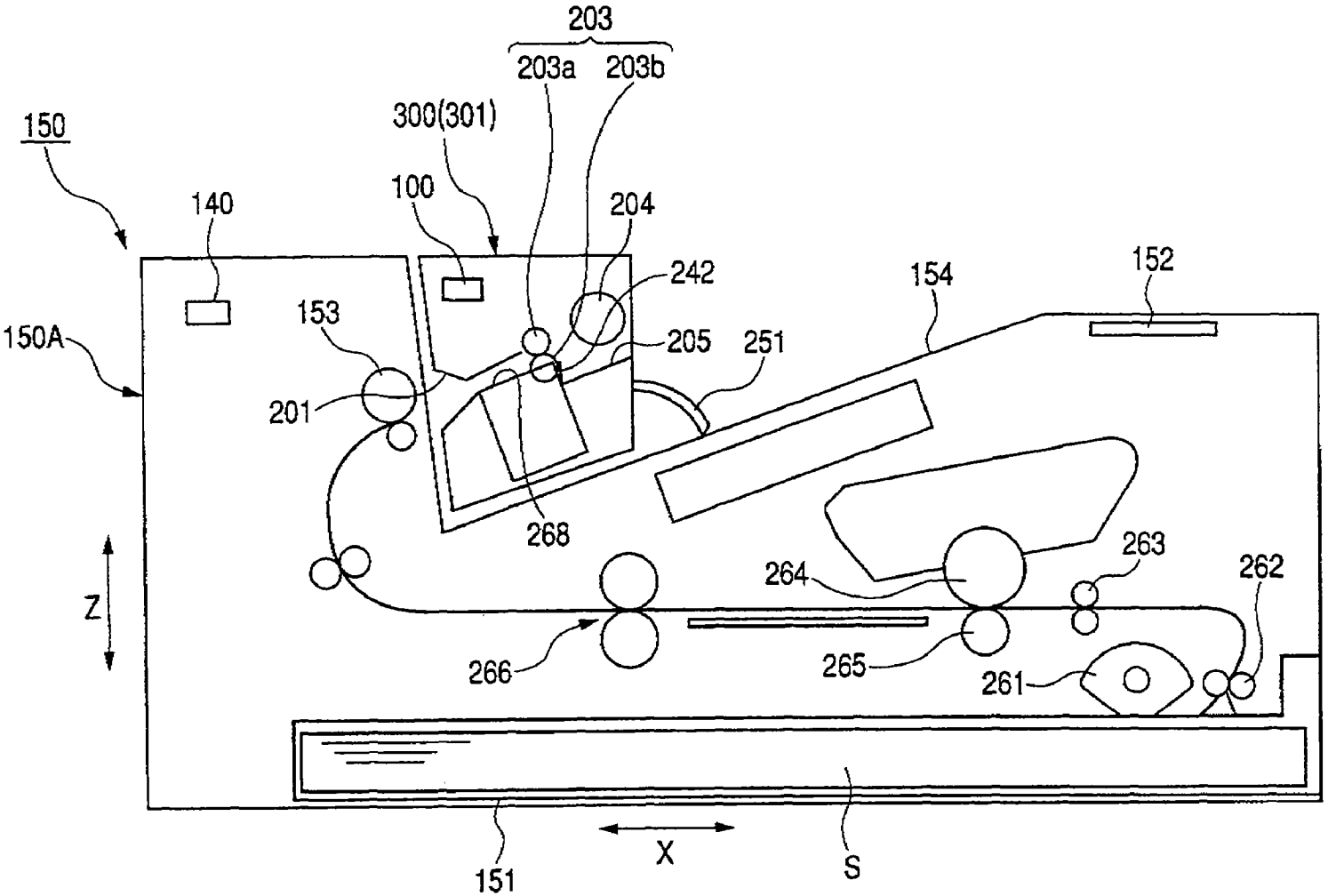
FIG. 1 is a cross sectional view along a sheet conveying direction of an image forming apparatus in an embodiment of the invention.
Figure 6:
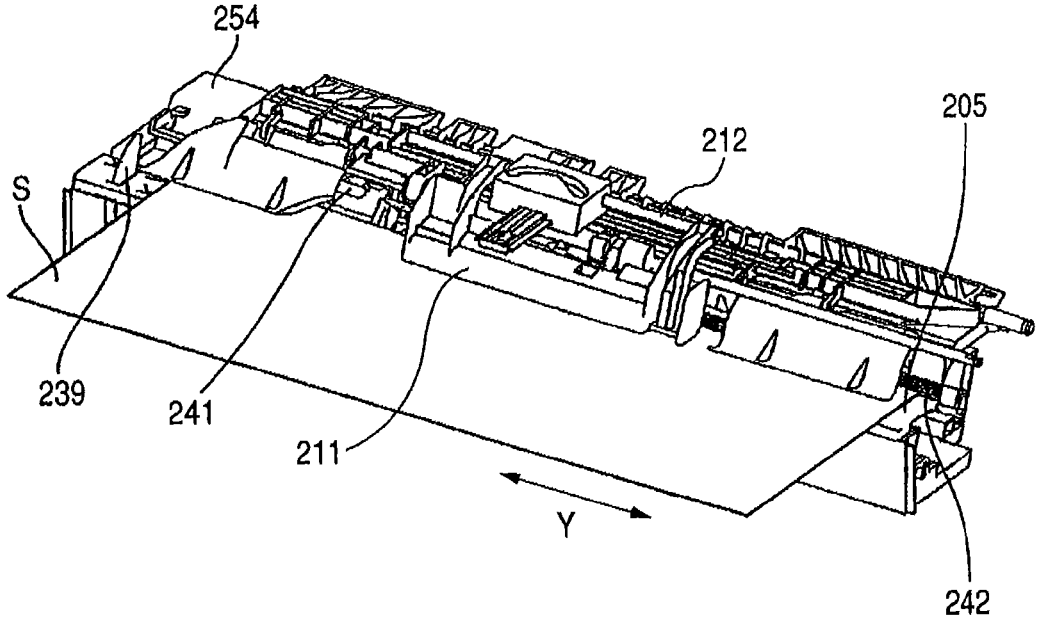
FIG. 6 is a diagram illustrating a state where the processing roller moves in the width direction and starts a side edge alignment of the sheet.
Figure 8:
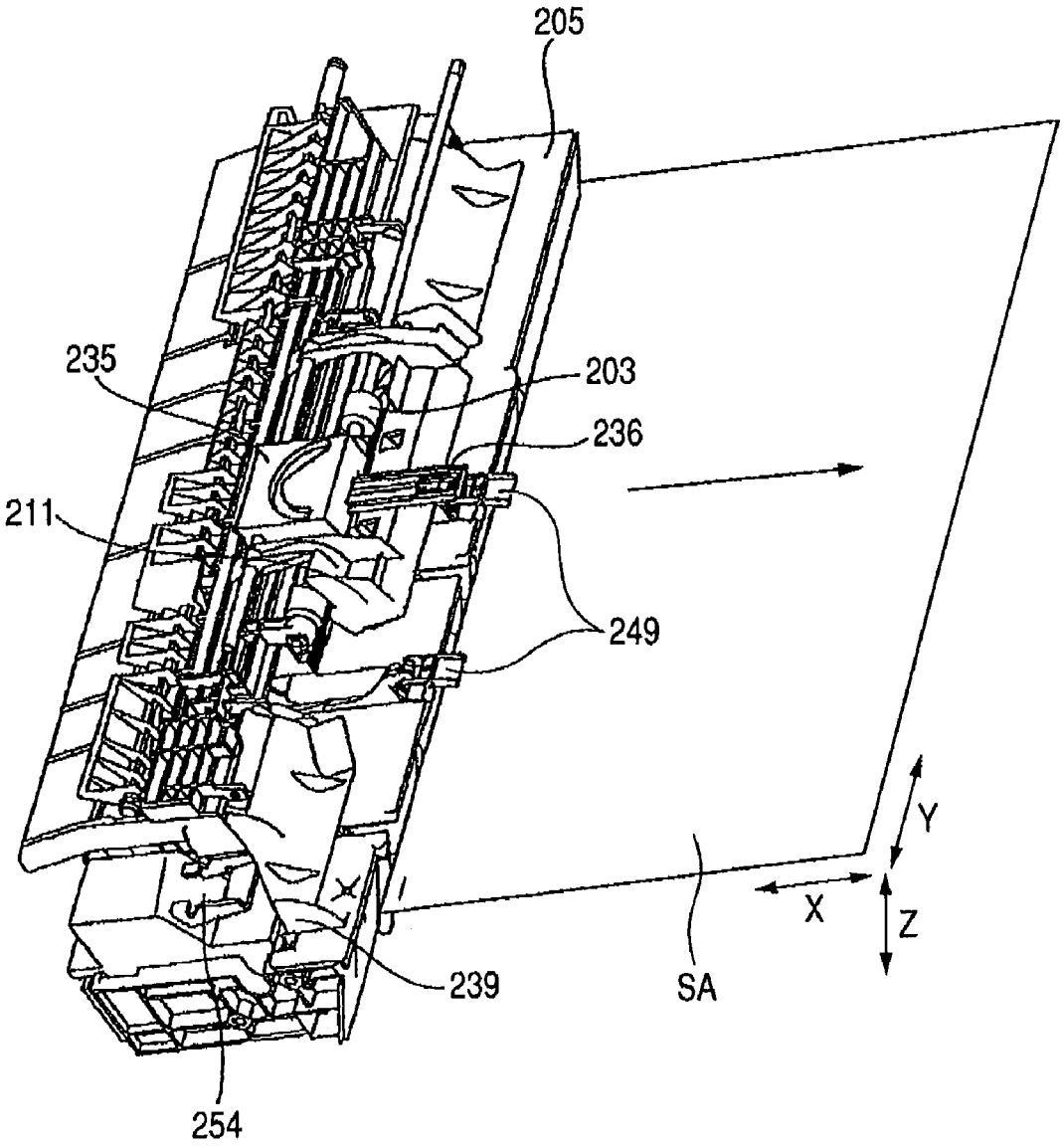
FIG. 8 is a diagram illustrating a state where a sheet bundle has been ejected by ejecting claws.

In the description of the embodiments, a sheet conveying direction denotes a right/left direction (direction shown by an arrow X) in FIG. 1. An ejecting direction of a sheet denotes a direction from the left to the right in FIG. 1. A trailing edge of the sheet denotes an edge on the upstream side in the sheet conveying direction and also corresponds to an upstream edge. A leading edge of the sheet denotes an edge on the downstream side in the sheet conveying direction and also corresponds to a downstream edge. A side edge of the sheet denotes an edge along the sheet conveying direction. A width direction of the sheet denotes a direction (direction of an arrow Y in FIGS. 6 and 8) along the upper surface of the sheet in the direction which crosses the sheet conveying direction. The vertical direction denotes a vertical direction (direction of an arrow Z) in FIGS. 1 and 8. The width size of the sheet denotes a length in the width direction of the sheet.

(Image Forming Apparatus)

FIG. 1 is a cross sectional view along the sheet conveying direction of the image forming apparatus in the embodiment of the invention. An image forming apparatus 150 is an apparatus for forming an image onto a sheet. As an image forming apparatus 150, for example, there is a copying apparatus, a printer, a facsimile apparatus, and a multi-function apparatus. The image forming apparatus 150 is constructed by an apparatus main body 150A for forming the image onto the sheet and a sheet processing apparatus 300 (or 301) for processing the sheet on which the image has been formed. Although the sheet processing apparatus 300 or 301 has been connected as a purchase option to the apparatus main body 150A of the image forming apparatus, it may be built in the apparatus main body 150A. The sheet processing apparatus 300 or 301 aligns the edge of the sheet (executes an aligning process).

The apparatus main body 150A of the image forming apparatus 150 forms the image onto the sheet based on information from an outside source. A sheet cassette 151 in which the sheets S have been enclosed is provided in a lower portion of the apparatus main body 150A so that the sheet cassette can be freely pulled out to the right in FIG. 1. The sheet S in the sheet cassette 151 is fed out of the sheet cassette 151 by a pickup roller 261 and is conveyed to a position between, for example, a photosensitive drum 264 as an image forming unit and a transfer roller 265 by a main body conveying roller pair 262 and a registration roller pair 263. A toner image has previously been formed on the photosensitive drum 264. Therefore, the toner image on the photosensitive drum 264 is transferred onto the sheet. The toner image on the sheet onto which the toner image has been transferred is fixed by a fixing unit 266 and, thereafter, the sheet is sent to the sheet processing apparatus 300 (or 301) by a discharge roller pair 153.

The user operates an operation panel 152 provided for the apparatus main body 150A, thereby making the apparatus main body 150A and the sheet processing apparatus 300 or 301 operative. The operation panel 152 may be provided for the sheet processing apparatus 300 or 301. The apparatus main body 150A is controlled by a main body control unit 140.

(Sheet Processing Apparatus)

A direction of the sheet processing apparatus 300 illustrated in FIG. 1 and a direction of the sheet processing apparatus 300 illustrated in FIGS. 2 to 5 are opposite.

The sheet processing apparatus 300 performs what is called a center-main conveyance in which the sheet is conveyed in the state where the center in the width direction of the sheet and the center in the width direction of the sheet conveying path are made coincident. In the sheet processing apparatus, as illustrated in FIGS. 9 to 11, the center (CL1) in the width direction of the processing roller 204 existing at the home position also coincides with the center (CL2) in the width direction of the sheet. The home position of the processing roller 204 is also a movement start position where the processing roller 204 starts the movement in the width direction of the sheet toward the width restricting plate 239.

It is not always necessary that the sheet is fed by the center-main conveyance. It is sufficient that a side edge of the sheet is not guided by a side wall of a conveying path but the sheet is away from the side wall and conveyed. Therefore, it is not always necessary that the center (CL1) in the width direction of the processing roller 204 existing at the home position coincides with the center (CL2) in the width direction of the sheet.

The operation of the sheet processing apparatus 300 or 301 is controlled by a CPU 100 (FIG. 1). While transmitting and receiving signals to/from the main body control unit 140 (FIG. 1) of the apparatus main body 150A through a serial I/O 130, the CPU 100 (FIG. 15) controls the operation of the sheet processing apparatus 300 or 301. Either one of the CPU 100 and the main body control unit 140 may be integrated with the other.

Figure 15:
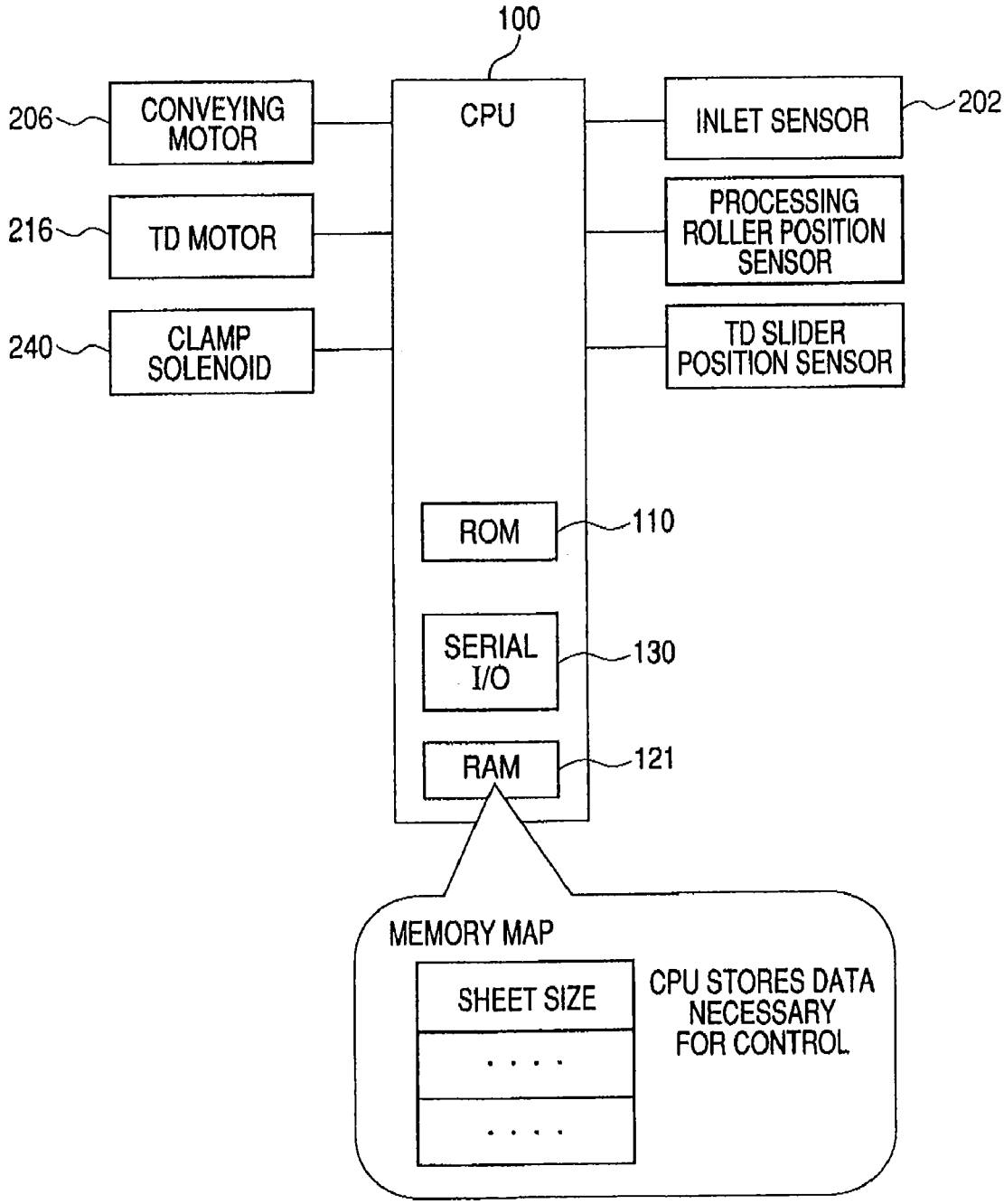
FIG. 15 is a control block diagram of the sheet processing apparatus.
Figure 16A:
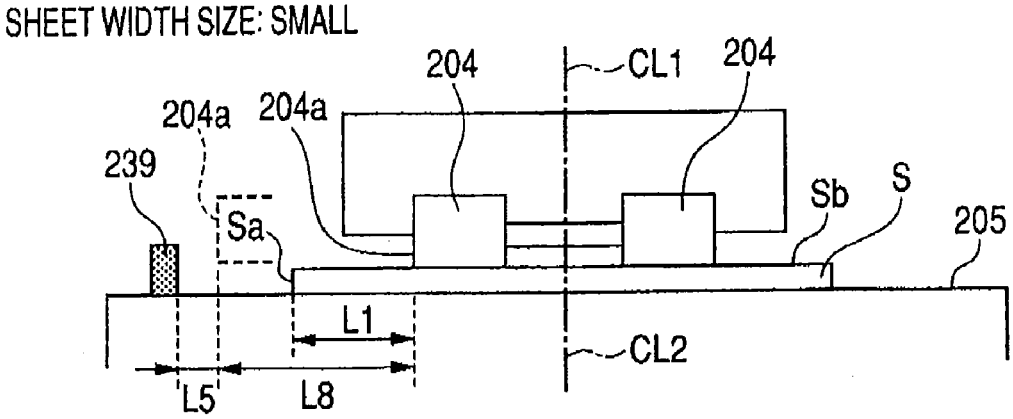
Figure 16B:
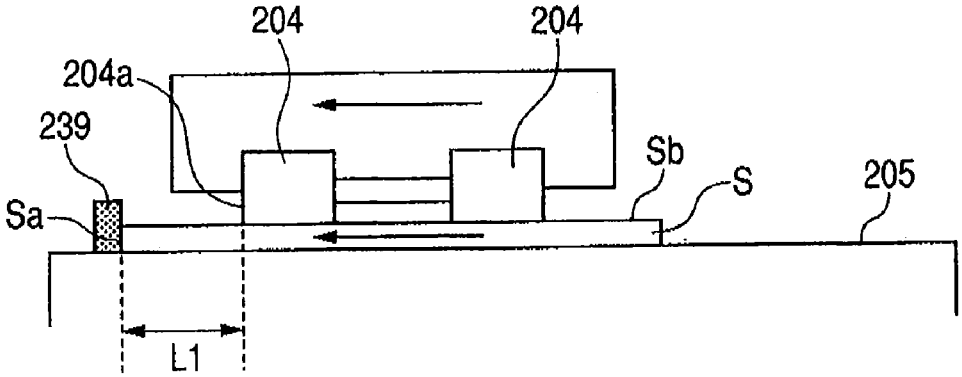
Figure 16C:
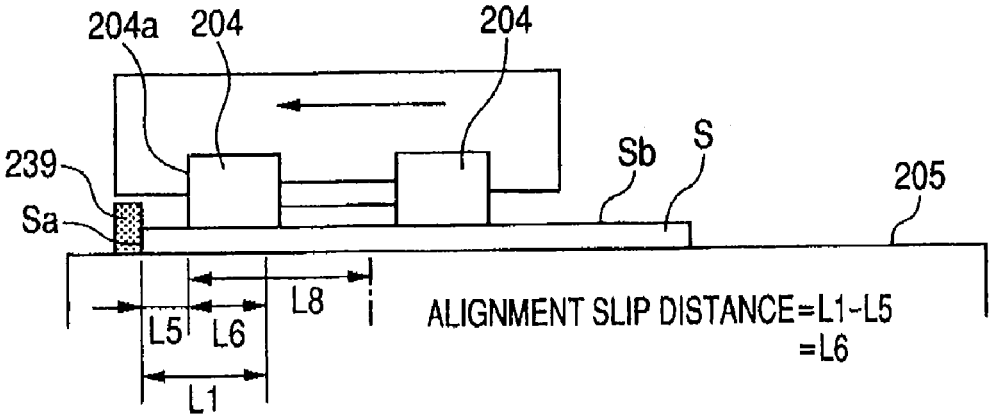

An inlet sensor 202 (FIG. 2) for detecting the sheet sent from the apparatus main body 150A to a sheet receiving portion 201 is connected to the CPU 100 (FIG. 15).

A conveying motor 206, a TD motor 216, and a clamp solenoid 240 are also connected to the CPU 100. The conveying motor 206 rotates a driving roller 203*a* (FIG. 1). The TD motor 216 moves ejecting claws 249 in the sheet conveying direction. The TD motor 216 also moves the processing roller 204 through a mechanism (not shown) in the sheet conveying direction, the width direction of the sheet, and the vertical direction. The clamp solenoid 240 is opened by rotating a gripper 241 upward.

Figure 12:
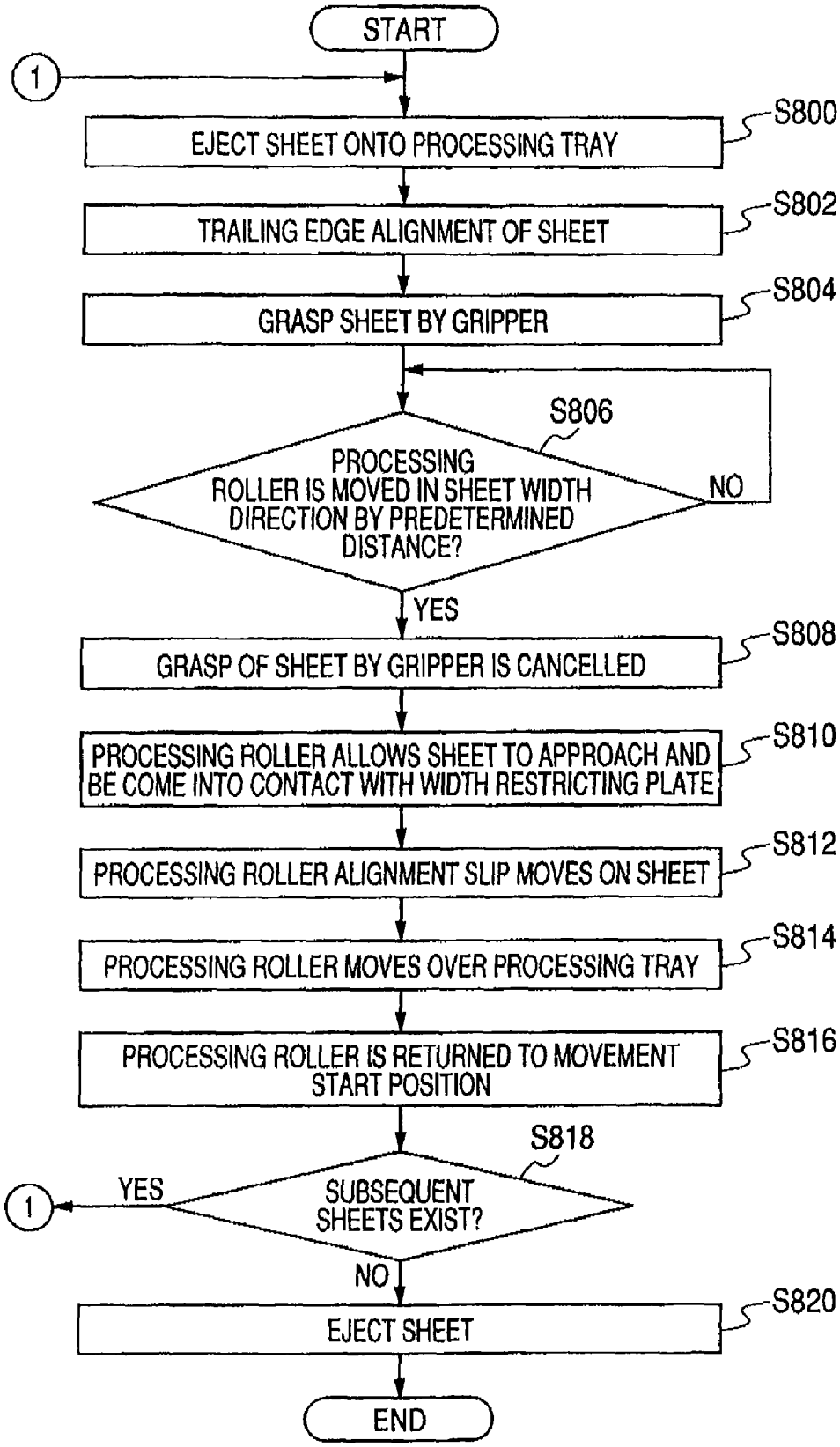
FIG. 12 is a flowchart for describing the operation in FIGS. 9A to 9D.
Figure 13:
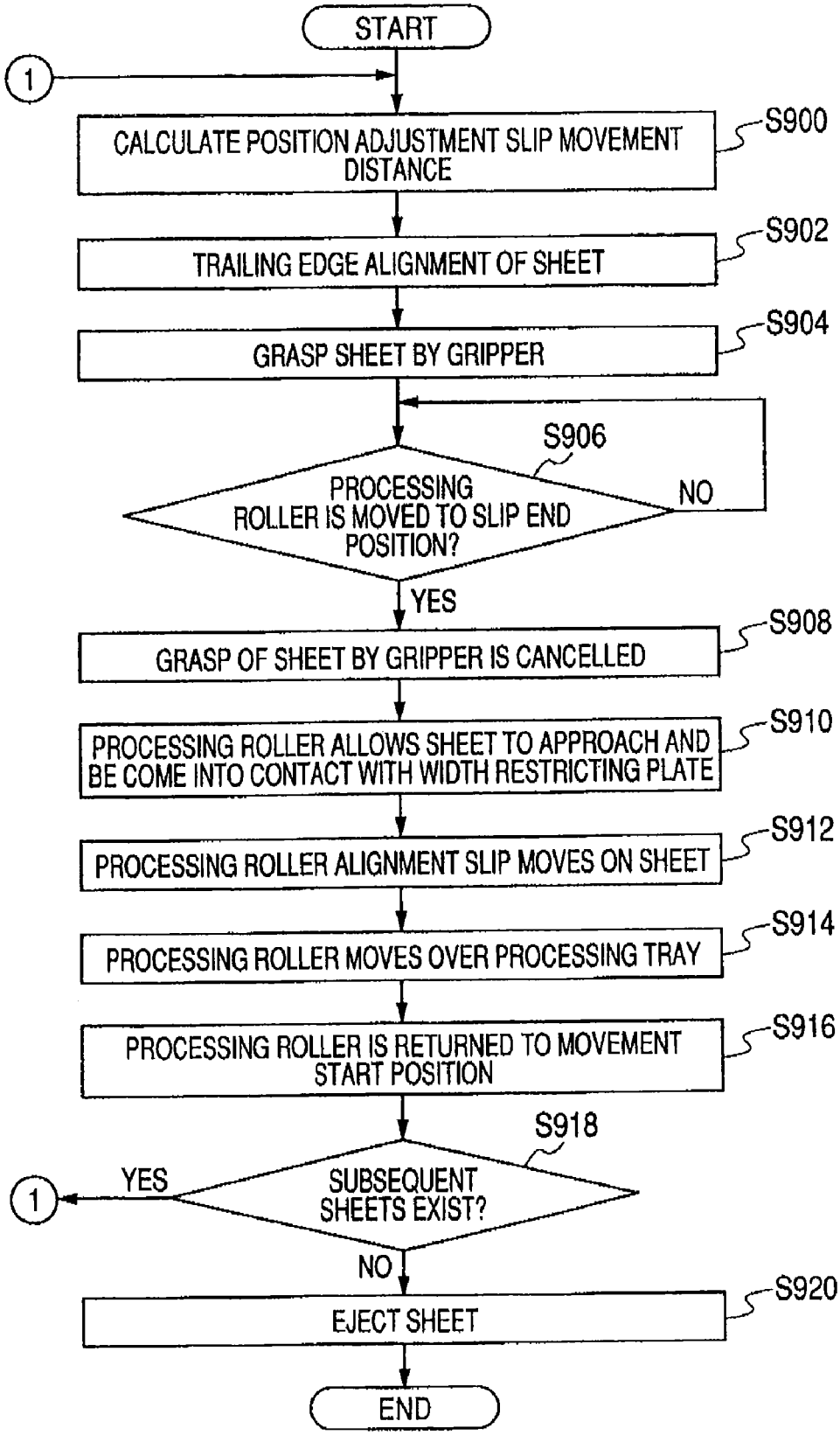
FIG. 13 is a flowchart for describing the operation in FIGS. 10A to 10D and FIGS. 11A to 11D.

A ROM 110 in which control procedures shown in FIGS. 12 and 13 and the like which are executed by the CPU and control order of processes such as sheet aligning process, stapling process, and the like have previously stored is connected to the CPU 100. A RAM 121 for storing various kinds of data such as arithmetic operation data of the CPU 100, control data received from the main body control unit 140 of the apparatus main body 150A, and the like is also connected to the CPU 100.

The operation panel 152 provided for the apparatus main body 150A may be provided for the sheet processing apparatus 300 or 301. In this case, the operation panel 152 may be connected to the CPU 100.

(Sheet Processing Apparatus)

Figure 2:
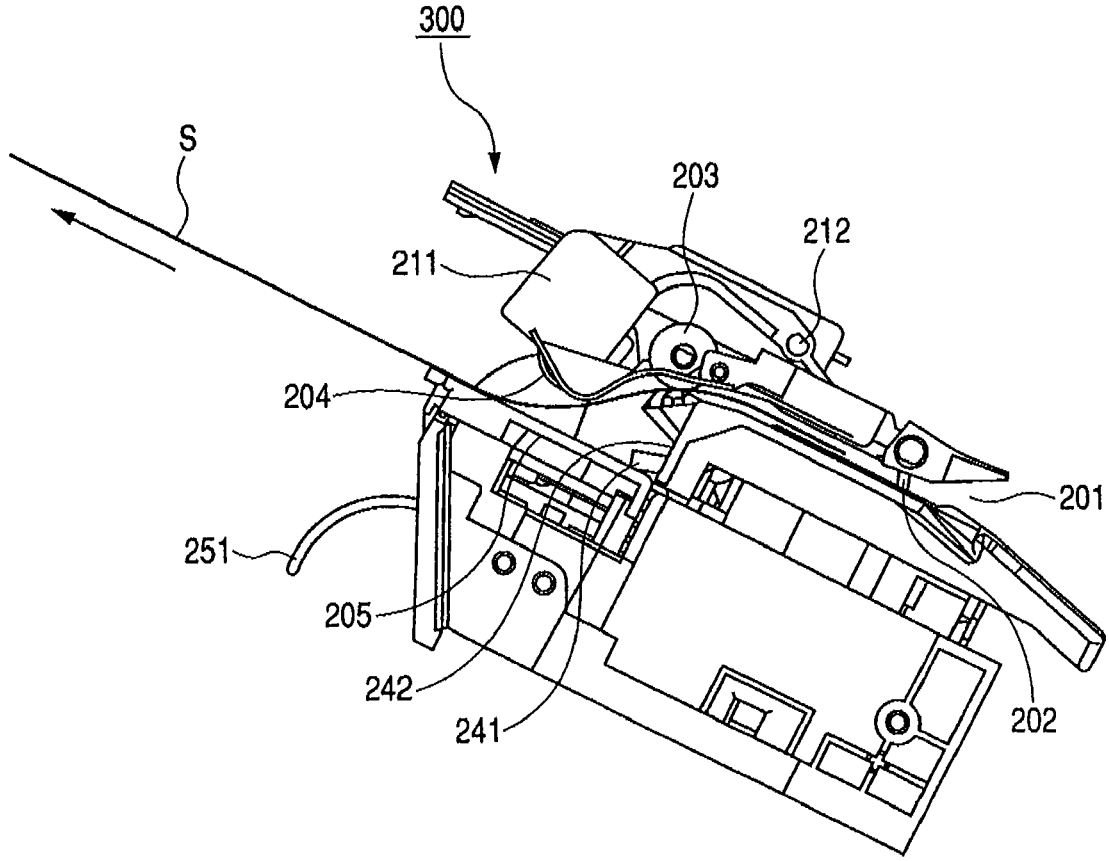
FIG. 2 is a diagram for describing the operation of a sheet processing apparatus in the embodiment of the invention and is a diagram illustrating a state where a sheet has been fed to the sheet processing apparatus.

In FIG. 2, in the sheet processing apparatus 300, the sheet ejected from the apparatus main body 150A (FIG. 1) is received by the sheet receiving portion 201 and conveyed along a guiding path 268. The inlet sensor 202 detects the received sheet. Thus, the CPU 100 rotates the conveying motor 206 and allows a conveying roller pair 203 to convey the sheet onto the processing tray 205 (FIG. 12, S800). The conveying roller pair 203 is constructed by the driving roller 203*a* and a driven roller 203*b*. At this time, since the sheet processing apparatus performs the center-main conveyance, the center in the width direction of the sheet and the center in the sheet width direction of the conveying roller pair 203 coincide. Therefore, the sheet is away from the width restricting plate 239, which will be described hereinafter, and is ejected onto, for example, the processing tray 205 serving as a stacking unit. The processing roller 204 is provided for a holder 211. Since the holder 211 is in a state where it has been inclined upward when the sheet is received, the processing roller 204 has been retreated upward.

Figure 3:
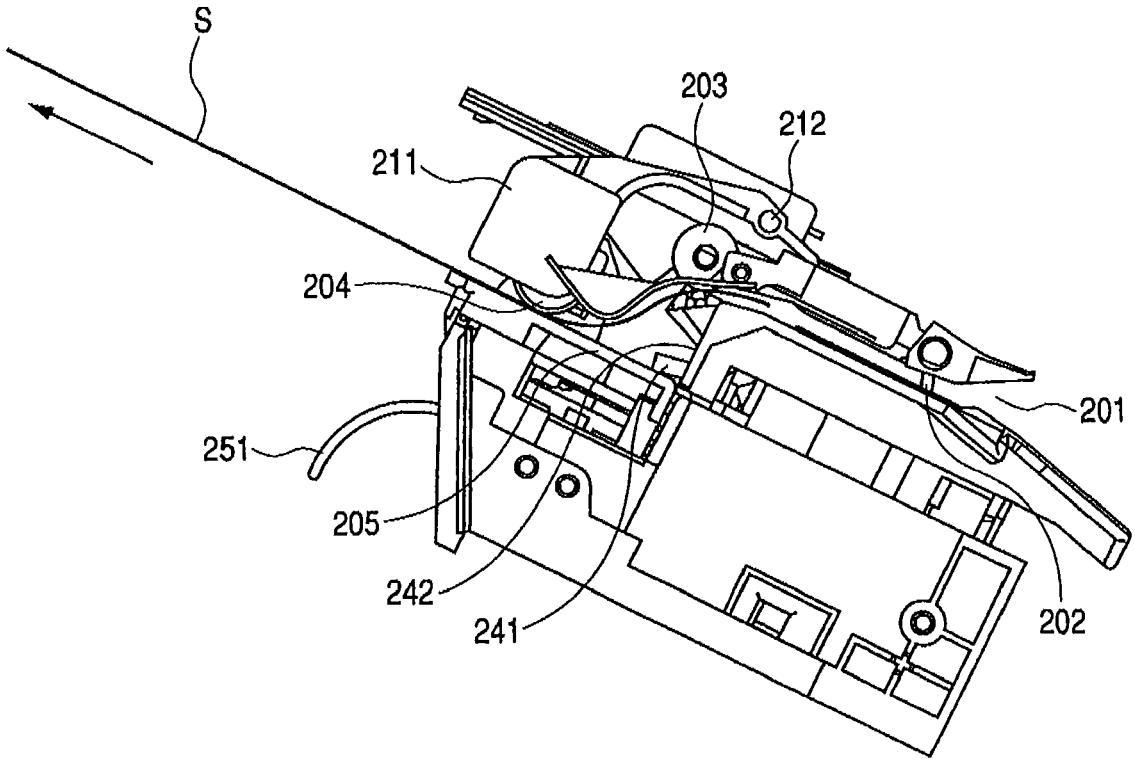
FIG. 3 is a diagram illustrating a state just before a trailing edge of the sheet is ejected and is a sequel to FIG. 2.

In FIG. 3, after the inlet sensor 202 detected the sheet, the processing roller 204 descends onto the sheet. The sheet is conveyed to the downstream side by the rotation of the conveying roller pair 203 and the movement to the downstream side in the sheet conveying direction of the processing roller 204 whose rotation has been stopped. When a trailing edge of the sheet exits from the conveying roller pair 203, only the processing roller 204 conveys the sheet to the downstream side.

Figure 4:
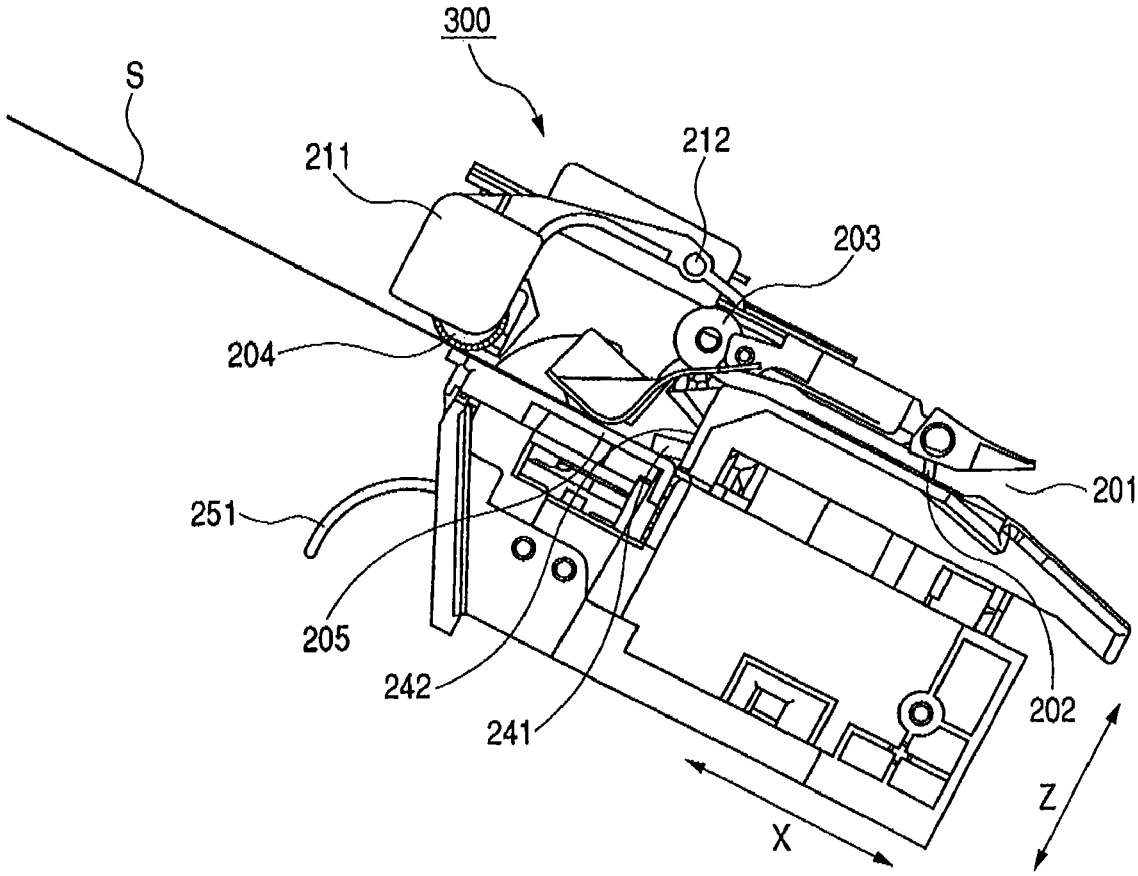
FIG. 4 is a diagram for describing the operation at the time when a processing roller aligns the trailing edge of the sheet and is a diagram illustrating a state where the sheet approaches a trailing edge restricting plate.

In a rotation stop state, in FIG. 4, while returning to the upstream side in the sheet ejecting direction from the position where the conveyance of the sheet S in the sheet ejecting direction was finished, the processing roller 204 returns the sheet to the upstream side in the sheet ejecting direction so that the trailing edge of the sheet is brought into contact with a trailing edge restricting plate 242.

Figure 5:
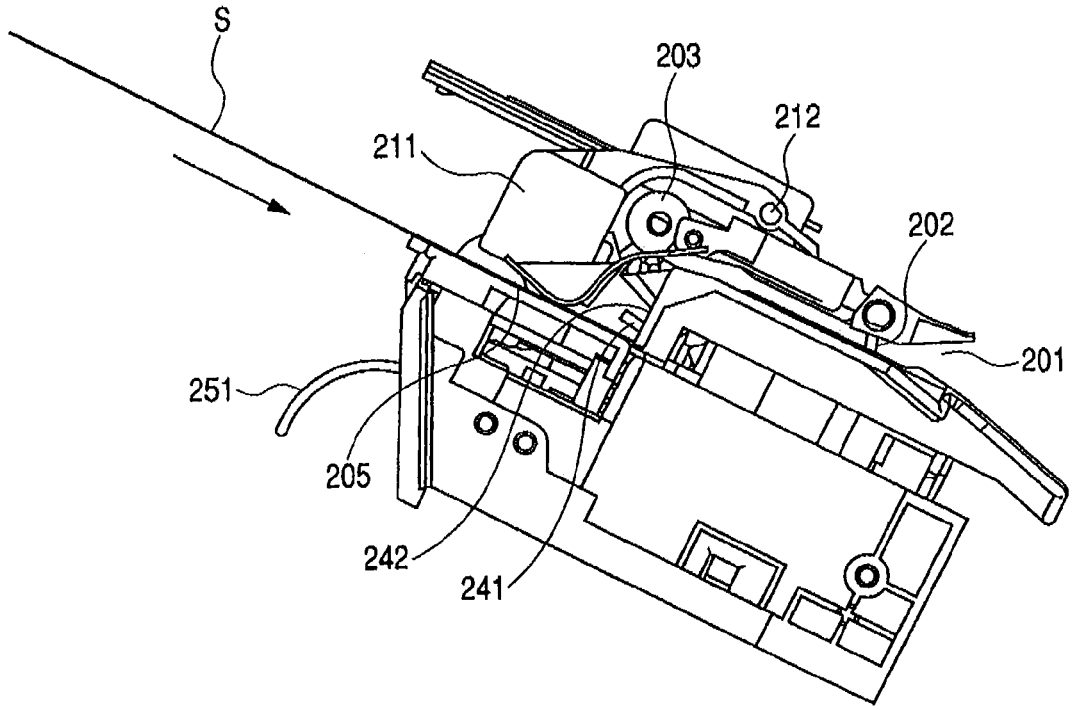
FIG. 5 is a diagram for describing the operation at the time when the processing roller aligns the trailing edge of the sheet and is a diagram illustrating a state where the sheet has been come into contact with the trailing edge restricting plate.

At this time, in FIG. 5, the gripper 241 has been opened before the processing roller 204 starts to convey the sheet S to the upstream side in the sheet ejecting direction. Therefore, the sheet is brought into contact with the trailing edge restricting plate 242 by the processing roller 204 and the trailing edge of the sheet is aligned without being obstructed by the gripper 241 (FIG. 12, S802).

The gripper 241 will be described here. The gripper 241 is inclined upward by the clamp solenoid 240 (FIG. 15) and is inclined downward by a spring (not shown). The gripper 241, the clamp solenoid 240 (FIG. 15), the spring (not shown), and the like construct a movement blocking unit. The gripper 241 is inclined downward, presses the sheet onto the processing tray 205, and grasps the sheet in cooperation with the processing tray 205, thereby blocking the movement in the width direction of the sheet to the processing tray 205. The gripper 241 may be formed by a pair of upper and lower claws. In this case, the claw on the lower side (not shown) is fixedly provided at a position of the same plane as a sheet stacking surface of the processing tray 205 and the claw on the upper side is inclined in the vertical direction for the lower claw and grasps the sheet in cooperation with the lower claw.

Figure 7:
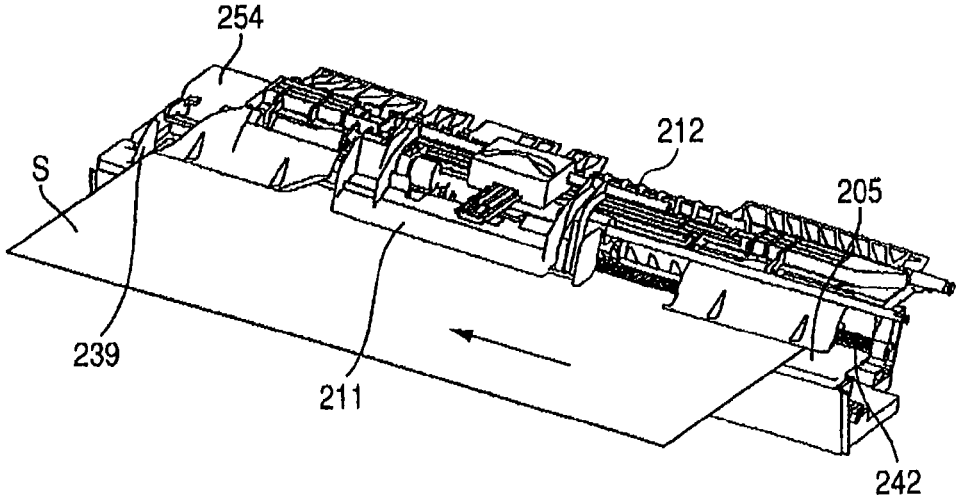
FIG. 7 is a diagram illustrating a state where the processing roller has moved in the width direction and is making the side edge alignment of the sheet.
Figure 9A:
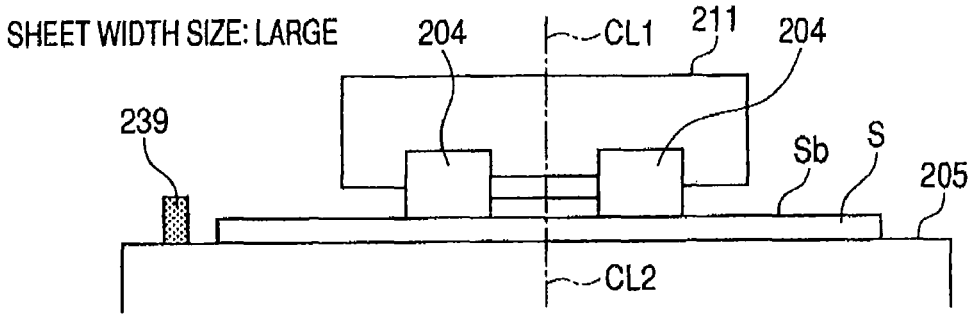
Figure 9B:
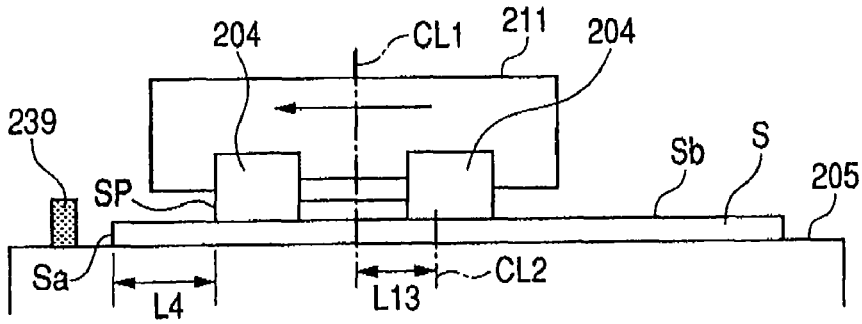

After the trailing edge alignment of the sheet was made, the CPU 100 turns off the clamp solenoid 240. The gripper 241 grasps the sheet in cooperation with the processing tray 205 and blocks the movement of the sheet so that a positional deviation of the sheet from the processing tray 205 does not occur (FIG. 12, S804). Subsequently, the CPU 100 controls the TD motor 216, thereby allowing the processing roller 204 to move in an arrow direction (width direction) close to, for example, the width restricting plate 239 as a side edge aligning unit in FIGS. 6 and 7 (S806). At this time, when a grasping force of the gripper 241 which grasps the sheet is compared with a conveying force at which the processing roller 204 intends to convey the sheet in the width direction, the conveying force is smaller than the grasping force. Therefore, the processing roller 204 slip moves (slides) on the sheet as illustrated in FIGS. 9A and 9B.

Simultaneously with that the processing roller 204 starts to move from the home position (movement start position), the processing roller 204 position adjustment slip moves on the upper surface Sb of the sheet grasped on the processing tray 205 by the gripper 241. Therefore, the home position (movement start position) is a slip start position.

When, for example, the CPU serving as a block cancelling unit allows the processing roller 204 to move from the movement start position in FIG. 9 in the sheet width direction by a predetermined distance (L13) on the upper surface Sa of the sheet whose movement was blocked by the gripper 241 (FIG. 12, YES in S806), the CPU opens the gripper 241. The grasp of the sheet is cancelled (S808). The distance L13 has previously been stored in the ROM 110.

Thus, a relative position between the processing roller 204 and the sheet is adjusted by the distance L13 at which the processing roller 204 has slip moved for the sheet. The slip movement in this instance is referred to as a position adjustment slip movement. A distance between the side edge Sa of the sheet and the edge surface 204*a* of the processing roller 204 is equal to L4. The position of the processing roller 204 is a slip end position SP. The distance L4 is shorter than the distance L2 (FIGS. 17A to 17C) in the related art.

Figure 9C:
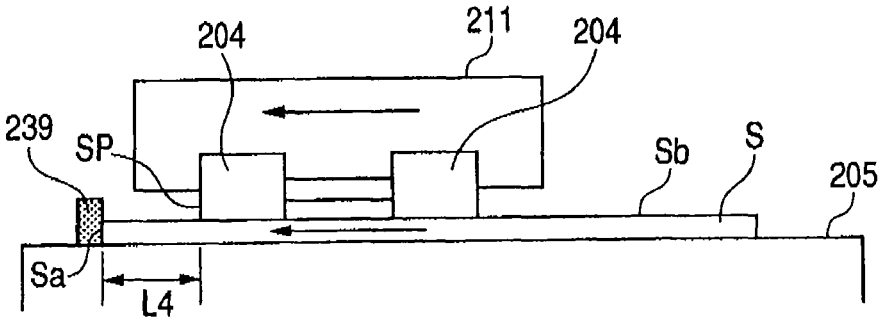
Figure 9D:
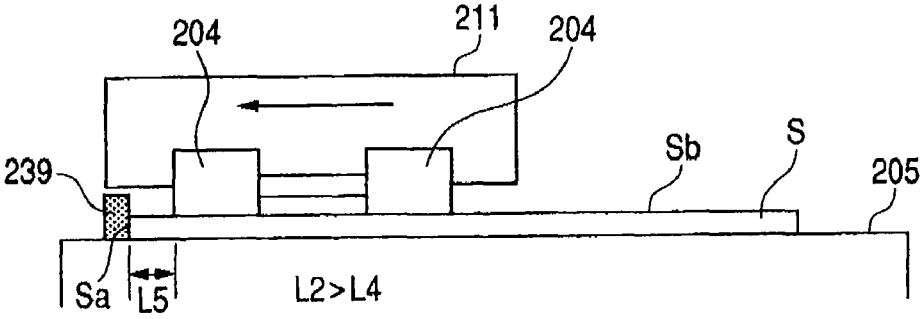
Figure 10A:
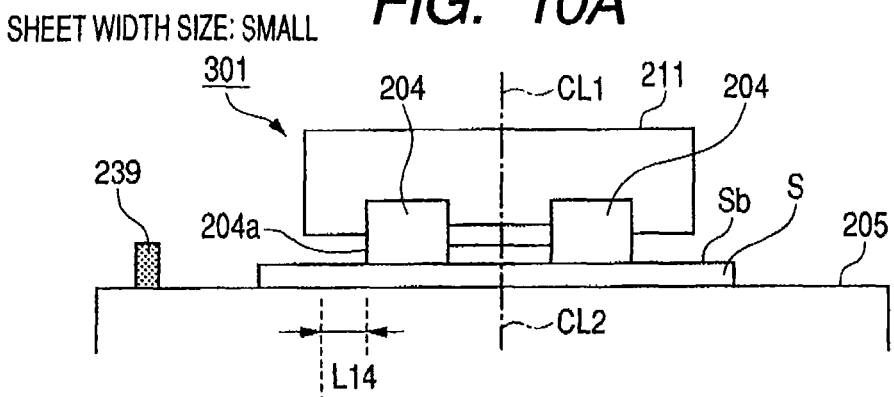
Figure 10B:
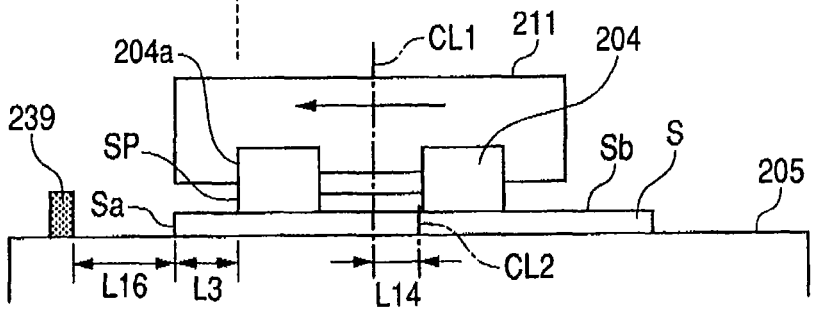
Figure 10C:
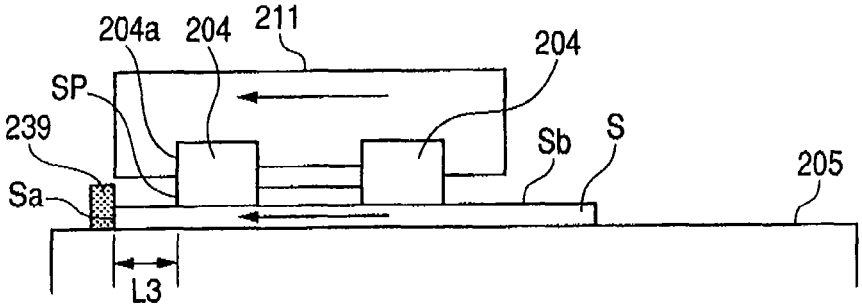
Figure 10D:
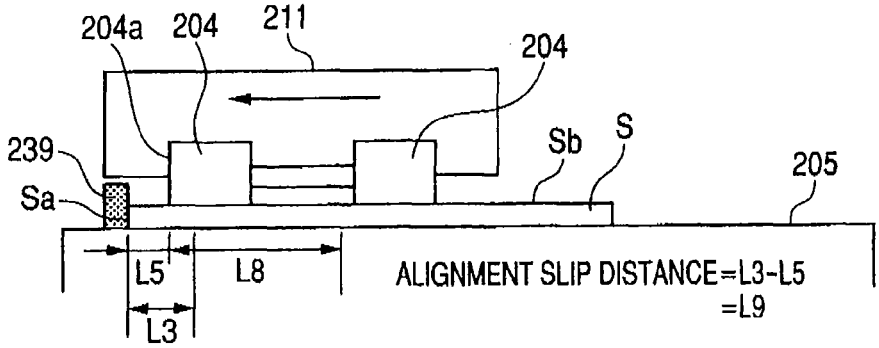
Figure 11A:
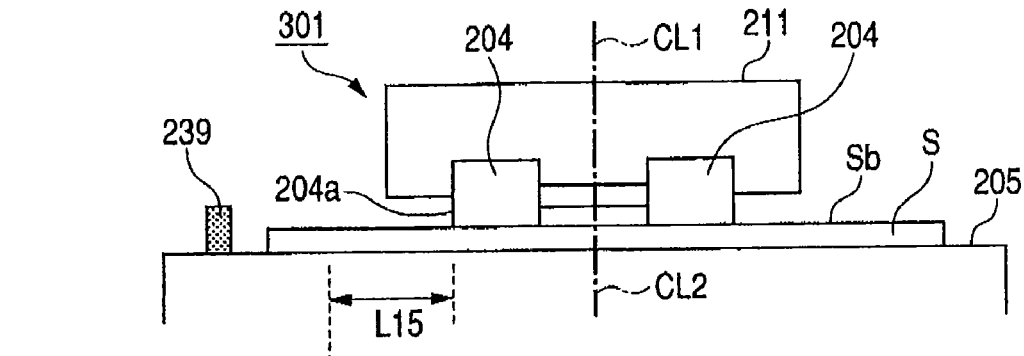
Figure 11B:
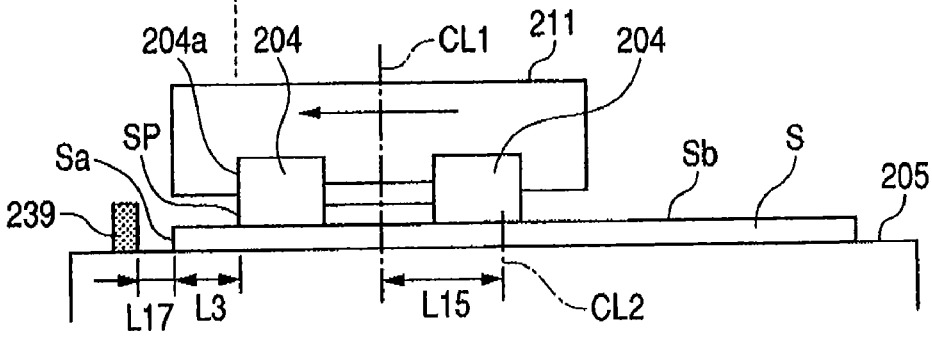
Figure 11C:
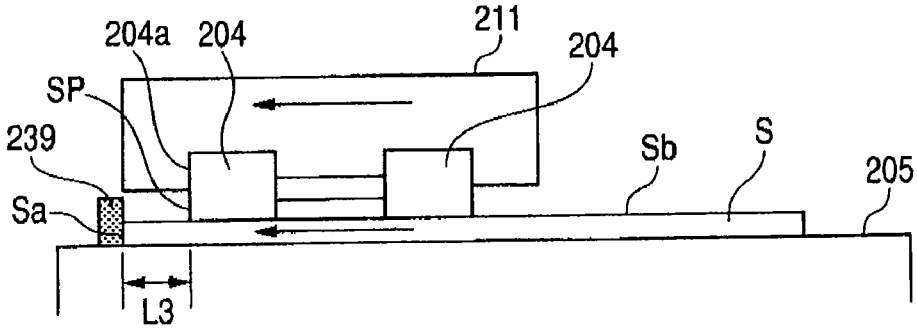
Figure 11D:
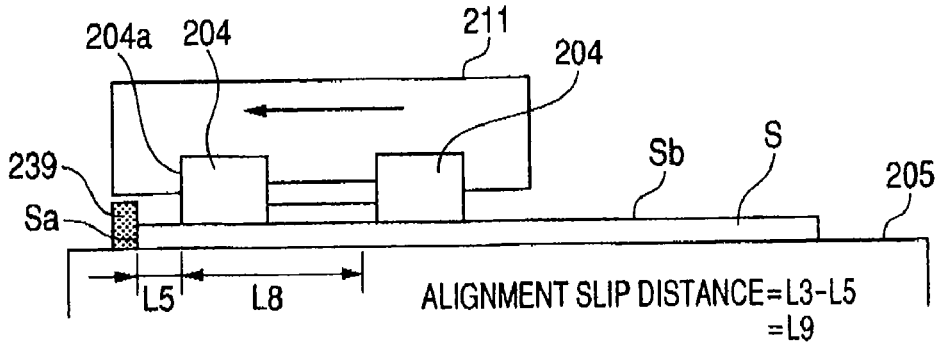

The processing roller 204 continues such a movement that it approaches the width restricting plate 239 and the sheet which can move freely because the gripper 241 has been opened is moved and made to approach the width restricting plate 239 by the processing roller 204 so as to be come into contact with the width restricting plate 239 as illustrated in FIG. 9C (S810). The processing roller 204 still continues the movement and slip moves on the sheet S (S812). As illustrated in FIG. 9D, when the processing roller 204 approaches to a position which is away from the width restricting plate 239 by the distance L5, the processing roller 204 stops. A slip distance L9 is equal to (L4−L5) and such a movement is called an alignment slip movement.

The distance L4 is set in such a manner that a buckling resistant force at which the sheet received and stopped by the width restricting plate 239 can endure the conveying force without buckling is larger than the conveying force at the time of moving the sheet to the width restricting plate 239 even after the processing roller 204 allowed the sheet to be come into contact with the width restricting plate 239. Therefore, the frequency of occurrence of the buckling of the sheet is smaller than that in the related art. The reason for it will be described hereinafter.

After that, the processing roller 204 is retreated upward (S814) and is returned to the home position (movement start position) (S816). At this time, the gripper 241 rotates downward and grasps the sheet on the processing tray 205, thereby preventing the sheet position from being deviated from the processing tray 205 (S818). The sheet processing apparatus 300 repeats the above operation until there are no subsequent sheets. After the sheets were stacked onto the processing tray 205 in a bundle form, the sheet processing apparatus 300 binds the sheet bundle by a stapler 254 (FIG. 8) or ejects the sheet bundle onto a stacking tray 154 by the ejecting claws 249 without binding them according to a mode set by the user (S820).

As mentioned above, when the processing roller 204 moves in the width direction of the sheet, its movement is temporarily blocked by the gripper 241. When the processing roller 204 position adjustment slip moves on the upper surface Sb of the sheet and reaches the slip end position SP, the block of the movement of the sheet by the gripper 241 is cancelled.

Figure 17A:
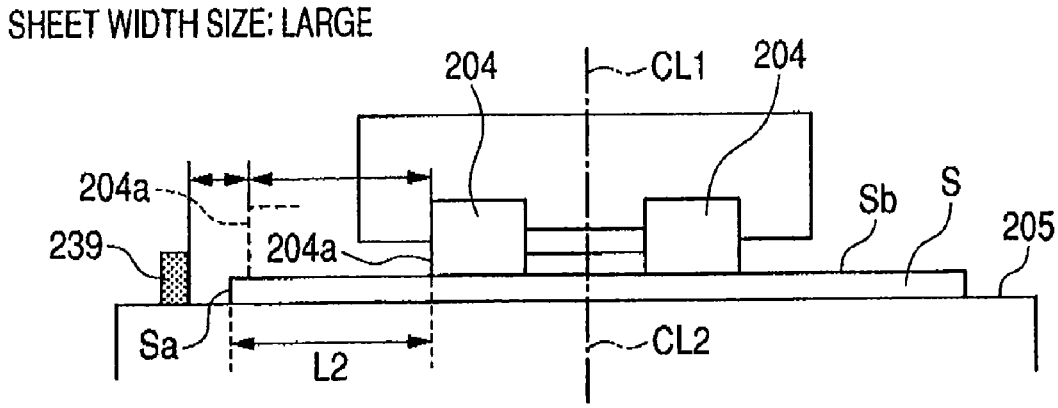
Figure 17B:
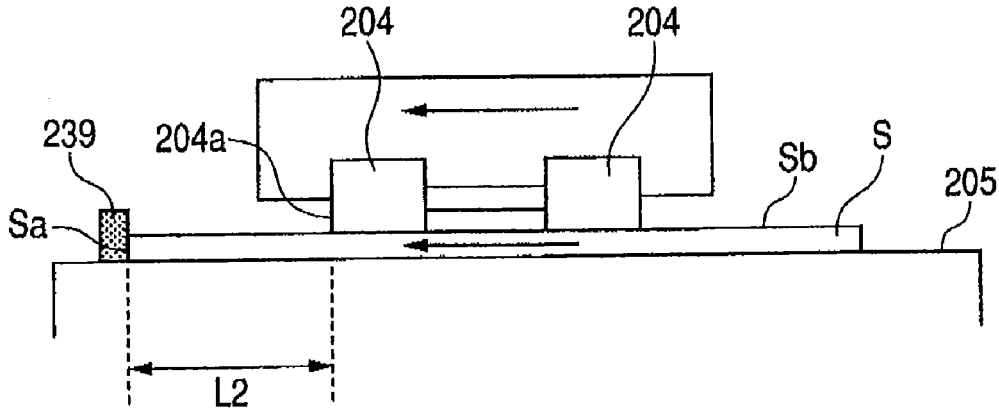
Figure 17C:
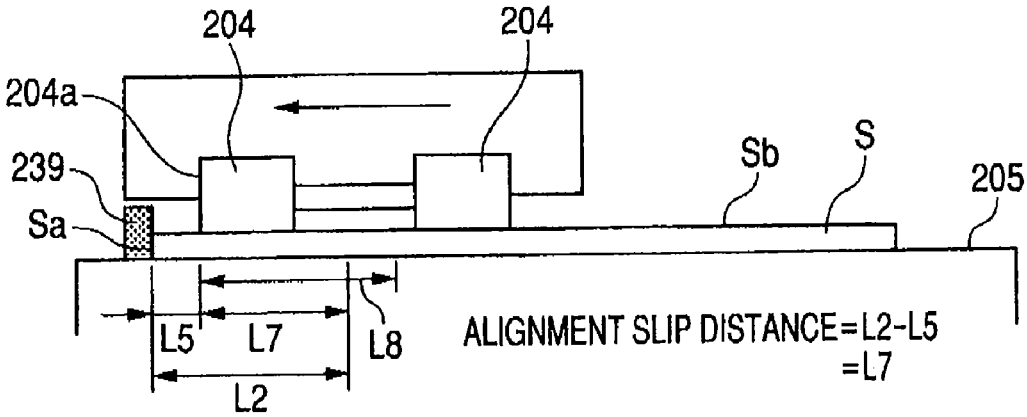

As mentioned above, in the sheet processing apparatus, after the processing roller 204 position adjustment slip moves by the predetermined distance (L13), the sheet moves. Therefore, the distance between the edge surface 204*a* of the processing roller 204 and the side edge Sa of the sheet can be more shortened than that in the related art by the distance (L13) corresponding to the position adjustment slip movement. In other words, since L13+L4=L2 in FIGS. 9A to 9D and 17A to 17C, L4<L2 (FIGS. 17A to 17C).

Consequently, in the sheet processing apparatus, since the movement of the sheet is blocked and the distance between the edge surface 204*a* of the processing roller 204 and the side edge Sa of the sheet is shortened, a deflection amount of the sheet at the time when it is come into contact with the width restricting plate 239 is reduced by such a shortened distance and the frequency of occurrence of the buckling of the sheet can be decreased. The side edge aligning precision of the sheet can be also improved.

Although the position adjustment slip movement distance (L13) has previously been stored in the ROM 110 (FIG. 15), it can be adjusted by the operation panel 152. Inherently, the shorter the position adjustment slip movement distance (L13) is, the shorter the slip distance for the sheet is and the smaller a damage that is exerted on the sheet is. It is, therefore, desirable to shorten the position adjustment slip movement distance as much as possible, thereby preventing the buckling from occurring in the sheet.

For this purpose, if the apparatus is constructed in such a manner that at least one of the timing when the movement of the sheet is blocked by the gripper 241 and the timing for cancelling the block of the movement can be changed by the operation panel 152, the position adjustment slip movement distance (L13) can be adjusted. If the position adjustment slip movement distance (L13) can be adjusted by the operation panel 152 as mentioned above, the side edge alignment of the sheet is actually made and such an optimum slip end position SP that the position adjustment slip movement distance is short and no buckling occurs in the sheet can be found.

Relations among a width size of the sheet, characteristics of the sheet, and the position adjustment slip movement distance have previously been stored in the ROM 110. The apparatus can be also constructed in such a manner that when the user inputs the sheet width size and the sheet characteristics, the position adjustment slip movement distance is automatically selected. In other words, at least one of the timing when the movement of the sheet is blocked by the gripper 241 and the timing for cancelling the block of the movement can be also changed according to information of the sheet characteristics. If the apparatus is constructed in such a manner that at least one of the timing for blocking the movement of the sheet and the timing for cancelling the block of the movement can be changed according to the sheet characteristics as mentioned above, the frequency of occurrence of the buckling of the sheet can be decreased. As characteristics, there are a thickness, a rigidity (tear-resistance), a material, a coefficient of friction, and the like of the sheet.

(Sheet Processing Apparatus of Another Embodiment)

Although the distance between the edge surface 204*a* of the processing roller and the side edge Sa of the sheet is shortened by blocking the movement of the sheet in the above description, the frequency of occurrence of the buckling may be decreased by setting the distance between the edge surface 204*a* of the processing roller and the side edge Sa of the sheet to be constant irrespective of the width size of the sheet.

The sheet processing apparatus 301 in which the distance between the edge surface 204*a* of the processing roller and the side edge Sa of the sheet is made constant irrespective of the width size of the sheet and the frequency of occurrence of the buckling is decreased will be described hereinbelow. It is assumed that the distance between the edge surface 204*a* of the processing roller 204 and the side edge Sa of the sheet has been set to L3.

When size information of the sheet (or sheet width size information) is input from the operation panel 152 by the user, the CPU 100 reads out the width size of the sheet from the ROM 110 based on the sheet size. The CPU 100 subtracts the distance L3 between the edge surface 204*a* of the processing roller 204 and the side edge Sa of the sheet from the width size of the sheet, thereby calculating the position adjustment slip movement distance of the processing roller 204 (FIG. 13, S900) The larger the width size of the sheet is, the larger the position adjustment slip movement distance is. In FIGS. 10A to 10D, when the width size is small, the position adjustment slip movement distance is equal to L14. In FIGS. 11A to 11D, when the width size is large, the position adjustment slip movement distance is equal to L15 (>L14).

After the trailing edge alignment of the sheet was made (S902), the CPU 100 turns off the clamp solenoid 240. The gripper 241 grasps the sheet in cooperation with the processing tray 205 (S904), thereby blocking the movement of the sheet so that the positional deviation of the sheet from the processing tray 205 does not occur. Subsequently, the CPU 100 controls the TD motor 216 so as to move the processing roller 204 in an arrow direction (width direction) in FIGS. 10A to 10D and FIGS. 11A to 11D. At this time, when the grasping force of the gripper 241 which grasps the sheet is compared with the conveying force at which the processing roller 204 intends to convey the sheet in the width direction, the conveying force is smaller than the grasping force. Therefore, the processing roller 204 position adjustment slip moves on the upper surface Sb of the sheet.

The processing roller 204 position adjustment slip moves by the distance L14 when the width size is small and by the distance L15 when the width size is large. When the processing roller 204 position adjustment slip moves to the slip end position SP that is away from the side edge Sa of the sheet S which is come into contact with the width restricting plate 239 by the distance L3 (YES in S906), the gripper 241 is opened by making the clamp solenoid 240 operative (S908). The slip end position SP is a position that is away from the side edge Sa of the sheet by the distance L3 (<L1<L2 (FIGS. 16A to 16C, FIGS. 17A to 17C)) and is constant irrespective of the width size of the sheet. The distance between the side edge Sa of the sheet and the width restricting plate 239 at this time is equal to L16 in the case of the sheet of the small width size and is equal to L17 in the case of the sheet of the large width size.

Thus, the relative position of the processing roller 204 and the sheet is adjusted by the distance (L14, L15) at which the processing roller 204 slip moved for the sheet.

The gripper 241 is opened and the processing roller 204 allows the sheet side edge to be come into contact with the width restricting plate 239 (S908, S910).

Since the movement distance (L8) of the processing roller 204 is constant, even if the side edge Sa of the sheet is brought into contact with the width restricting plate 239, the processing roller 204 further moves in the arrow direction (width direction) in FIGS. 10A to 10D and FIGS. 11A to 11D. However, when the buckling resistant force of the sheet to the width restricting plate 239 is compared with the conveying force of the processing roller, since the conveying force is smaller than the buckling resistant force, the processing roller 204 further alignment slip moves on the upper surface Sb of the sheet (S912). The alignment slip movement distance (L9) is constant irrespective of the sheet size (L9=L3−L5).

After that, the processing roller 204 is retracted upward (S914) and returned to the home position (movement start position) (S916). At this time, the gripper 241 is rotated downward and grasps the sheet on the processing tray 205, thereby preventing the position of the sheet from being deviated from the processing tray 205. The sheet processing apparatus 301 repeats the above operation until there are no subsequent sheets (S918). After the sheets were stacked onto the processing tray 205 in a bundle form, the sheet processing apparatus 301 binds the sheet bundle by the stapler 254 (FIG. 8) or ejects the sheet bundle onto the stacking tray 154 by the ejecting claws 249 without binding them according to the mode set by the user (S920).

A relation between the movement distance (L8) of the processing roller 204 and another distance is L8=L14+L16+(L9=L3−L5) in the case of the sheet of the small width size and is L8=L15+L17+(L9=L3−L5) in the case of the sheet of the large width size.

Therefore, since the distance L3 between the edge surface 204*a* of the processing roller and the side edge Sa of the sheet is set to be shorter than that in the related art, the sheet processing apparatus 301 can reduce the frequency of occurrence of the buckling by decreasing the deflection amount of the sheet at the time when the side edge Sa of the sheet is brought into contact with the width restricting plate 239. Thus, the side edge aligning precision of the sheet can be improved. Since the distance L3 is made constant irrespective of the width size of the sheet, the frequency of occurrence of the buckling can be decreased irrespective of the width size of the sheet.

Although the distance L3 between the edge surface 204*a* of the processing roller 204 and the side edge Sa of the sheet has previously been stored in the ROM 110 (FIG. 15), the apparatus can be also constructed in such a manner that the distance L3 can be adjusted by the operation panel 152. Inherently, the shorter the position adjustment slip movement distance (L14, L15) is, the shorter the slip distance for the sheet is and the smaller the damage that is exerted on the sheet is. It is, therefore, desirable to shorten the position adjustment slip movement distance as much as possible, thereby preventing the buckling from occurring in the sheet.

For this purpose, if the apparatus is constructed in such a manner that at least one of the timing when the movement of the sheet is blocked by the gripper 241 and the timing for cancelling the block of the movement can be changed by the operation panel 152, the distance (L3) can be adjusted. If the position adjustment slip movement distance (L3) can be adjusted by the operation panel 152 as mentioned above, the side edge alignment of the sheet is actually made and such an optimum slip end position SP that the position adjustment slip movement distance is short and no buckling occurs in the sheet can be found.

Relations among the width size of the sheet, the characteristics of the sheet, and the various kinds of distances L3 according to the width size and the characteristics have previously been stored in the ROM 110. The apparatus can be also constructed in such a manner that when the user inputs the sheet width size and the sheet characteristics information, the distance L3 is selected. In other words, at least one of the timing when the movement of the sheet is blocked by the gripper 241 and the timing for cancelling the block of the movement can be also changed according to the sheet characteristics information. If the apparatus is constructed in such a manner that at least one of the timing for blocking the movement of the sheet is blocked and the timing for cancelling the block of the movement can be also changed according to the sheet characteristics as mentioned above, the frequency of occurrence of the buckling of the sheet can be decreased. As characteristics, there are the thickness, rigidity (tear-resistance), material, coefficient of friction, and the like of the sheet.

In the description of FIGS. 9A to 9D to FIG. 12, when the processing roller 204 starts to move in the width direction of the sheet, the gripper 241 blocks the movement of the sheet. Therefore, the home position and the movement start position of the processing roller 204 and the slip movement start position coincide. However, the timing when the movement of the sheet is blocked by the gripper 241 may be set to timing in the middle of the movement of the processing roller in the sheet width direction. In such a case, the slip movement start position of the processing roller 204 is a position in the middle of the movement. First, the sheet is moved in the width direction by the processing roller. The movement is temporarily blocked as it is moved. After that, the movement in the width direction is continued by the processing roller. Therefore, slip start position is not limited to the home position and the movement start position of the processing roller 204.

Since, for example, the processing roller 204 as a moving unit in the above description moves the sheet in the sheet conveying direction or in the sheet width direction in the rotation stop state, it may be a member which is merely come into contact with the sheet. Therefore, the moving unit is not limited to the processing roller 204.

Such a phenomenon that when the sheet processing apparatus makes the width alignment of the sheet, if the distance between the edge surface 204*a* of the processing roller 204 and the side edge Sa of the sheet is narrowed, the buckling becomes difficult to occur in the sheet will be described.

Figure 14A:
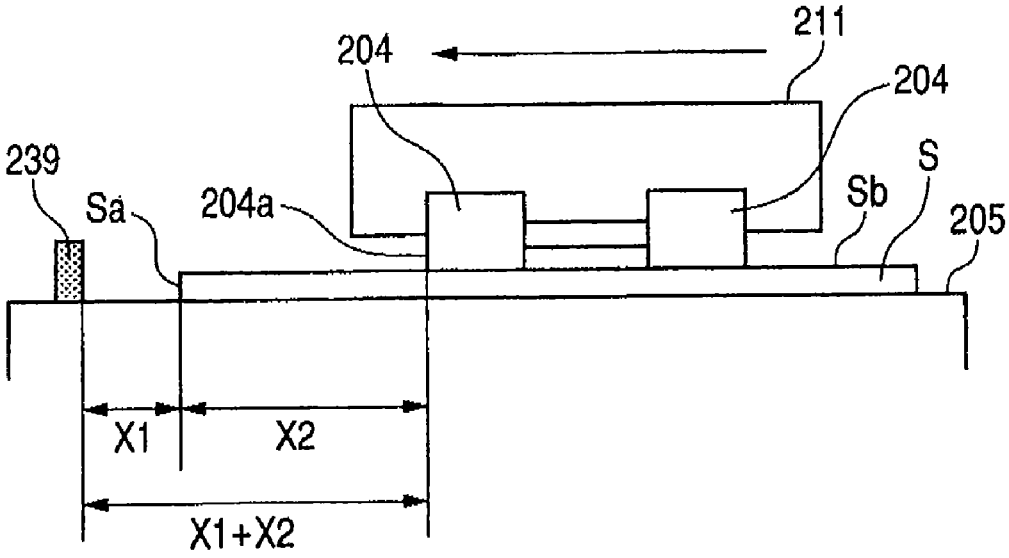
FIGS. 14A and 14B are diagrams for describing a situation where a buckling is not caused.
Figure 14B:
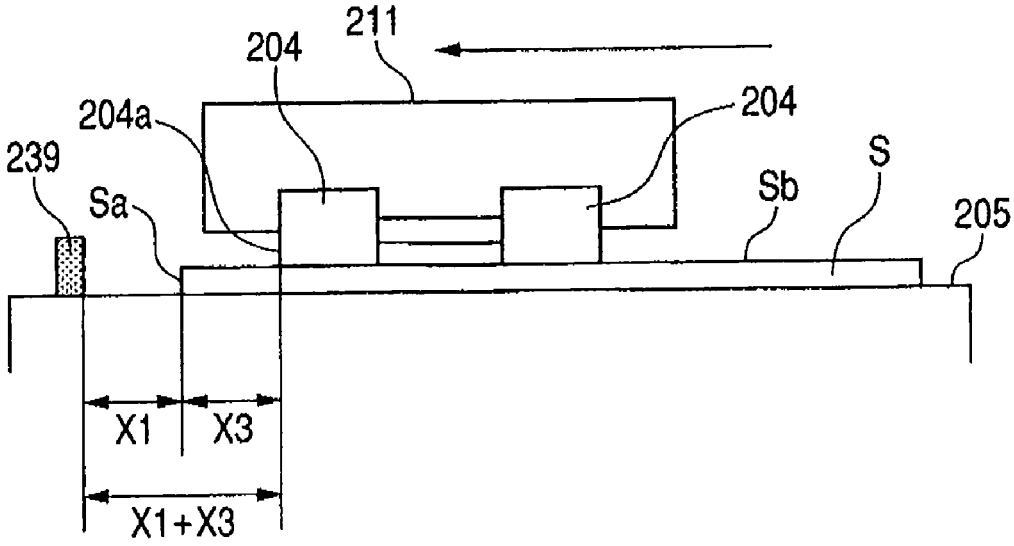

FIGS. 14A and 14B are diagrams illustrating positional relations at the time of making the side edge alignment of the sheet. FIG. 14A is the diagram of the positional relation at the time when the processing roller 204 is not position adjustment slip moved on the sheet. FIG. 14B is the diagram of the positional relation at the time when the processing roller 204 has been position adjustment slip moved on the sheet.

It is assumed that the processing roller 204 executes the aligning operation toward the arrow direction in FIGS. 14A and 14B. Assuming that the distance between the width restricting plate 239 and the side edge Sa of the sheet is equal to X1, this distance differs depending on the width size of the sheet. The distance between the edge surface 204*a* of the processing roller 204 and the side edge Sa of the sheet is assumed to be X2. The distance from the width restricting plate 239 to the edge surface 204*a* of the processing roller 204 is equal to X1+X2. If the processing roller 204 slipped and moved for a position alignment on the sheet at the time of aligning, by setting X3 (<X2) by decreasing the distance of X2, a relation of (X1+X2)>(X1+X3) is derived as a result. Numerical values of (X1+X2) and (X1+X3) correspond to λ when they are expressed by the following equation of the buckling. $\sigma cr=C(\pi 2\times E)/\lambda 2$ (where, $\sigma cr$: buckling stress/C: terminal condition coefficient/E: Young's modulus/$\lambda$: slenderness ratio). Therefore, if the distance between the processing roller 204 and the width restricting plate 239 is decreased without changing the distance X1 between the width restricting plate 239 and the side edge Sa of the sheet, such an operation acts in an advantageous direction for the buckling.

According to the sheet processing apparatus in the related art, as described based on FIGS. 16A to 16C and FIGS. 17A to 17C, when the width size of the sheet is large, the distance from the side edge Sa of the sheet to the edge surface 204*a* of the processing roller 204 becomes long. The larger the width size, the longer will be the distance of slip which occurs after the sheet is brought into contact with the width restricting plate 239 is and the buckling is liable to occur.

On the other hand, according to the sheet processing apparatus of the embodiment, the frequency of occurrence of the buckling of the sheet can be reduced by narrowing the distance between the processing roller 204 and the width restricting plate 239 by changing the position adjustment slip movement distance of the processing roller 204 on the sheet according to the width size of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-043633, filed Feb. 25, 2008, which is hereby incorporated by reference herein in its entirety.

What is claimed is:

1. A sheet processing apparatus comprising:

a stacking unit on which an ejected sheet is stacked;

a moving unit which is brought into contact with an upper surface of the sheet stacked on the stacking unit so that the moving unit can slip and move the sheet in a direction which crosses a sheet ejecting direction; and a side edge aligning unit which receives a side edge along the sheet ejecting direction of the sheet when the sheet is moved in the crossing direction by the moving unit, wherein the moving unit further moves in a state where the sheet stacked on the stacking unit is in contact with the side edge aligning unit, and the sheet processing apparatus further includes a movement blocking unit which blocks the movement of the sheet which is moved to the side edge aligning unit by the moving unit, thereby allowing the moving unit to slip and move on the sheet so as to adjust a relative position with the sheet, and a controller which controls the movement blocking unit, wherein the controller allows the movement blocking unit to cancel the block of the movement of the sheet when the moving unit slips and moves by a predetermined distance.

2. An apparatus according to claim 1, wherein the block cancelling unit is capable of changing timing for allowing the movement blocking unit to cancel the block of the movement of the sheet.

3. An apparatus according to claim 1, wherein the movement blocking unit is capable of blocking the movement of the sheet even after it was come into contact with the side edge aligning unit and aligned.

4. A sheet processing apparatus comprising:

a stacking unit on which an ejected sheet is stacked;

a moving unit which is brought into contact with an upper surface of the sheet stacked on the stacking unit so that the moving unit can slip and move the sheet in a direction which crosses a sheet ejecting direction; and a side edge aligning unit which receives a side edge along the sheet ejecting direction of the sheet when the sheet is moved in the crossing direction by the moving unit, wherein the moving unit further moves in a state where the sheet stacked on the stacking unit so as to be away from the side edge aligning unit has been moved to and has been brought into contact with the side edge aligning unit, the sheet processing apparatus further includes a movement blocking unit which blocks the movement of the sheet which is moved to the side edge aligning unit by the moving unit, thereby allowing the moving unit to slip and move on the sheet so as to adjust a relative position with the sheet and a block cancelling unit which allows the movement blocking unit to cancel the block of the movement of the sheet, wherein the block cancelling unit calculates a position adjustment slip movement distance from a slip start position of the moving unit to a slip end position as a position away from the side edge of the sheet based on information of the sheet, and when the moving unit slips and moves by the position adjustment slip movement distance, the block cancelling unit allows the movement blocking unit to cancel the block of the movement of the sheet.

5. An apparatus according to claim 4, wherein the information of the sheet is width size information in the crossing direction of the sheet, and the block cancelling unit calculates the position adjustment slip movement distance based on the width size information, and when the moving unit slips and moves by the position adjustment slip movement distance, the block cancelling unit allows the movement blocking unit to cancel the block of the movement of the sheet.

6. An apparatus according to claim 4, wherein the information of the sheet is characteristics information regarding characteristics of the sheet, and the block cancelling unit has calculated the position adjustment slip movement distance based on the characteristics information, and when the moving unit slips and moves by the position adjustment slip movement distance, the block cancelling unit allows the movement blocking unit to cancel the block of the movement of the sheet.

7. An image forming apparatus comprising:

an image forming unit adapted to form an image onto a sheet; and a sheet processing apparatus for aligning a side edge of the sheet on which the image has been formed by the image forming unit, the sheet processing apparatus comprising:

a stacking unit on which an ejected sheet is stacked;

a moving unit which is brought into contact with an upper surface of the sheet stacked on the stacking unit so that the moving unit can slip and move the sheet in a direction which crosses a sheet ejecting direction; and a side edge aligning unit which receives the side edge along the sheet ejecting direction of the sheet when the sheet is moved in the crossing direction by the moving unit, wherein the moving unit further moves in a state where the sheet stacked on the stacking unit is in contact with the side edge aligning unit, and the sheet processing apparatus further includes a movement blocking unit which blocks the movement of the sheet which is moved to the side edge aligning unit by the moving unit, thereby allowing the moving unit to slip and move on the sheet so as to adjust a relative position with the sheet, and a controller which controls the movement blocking unit, wherein the controller allows the movement blocking unit to cancel the block of the movement of the sheet when the moving unit slips and moves by a predetermined distance.

8. A sheet processing apparatus comprising:

a stacking unit on which a sheet ejected in an ejecting direction is stacked;

a moving unit which is brought into contact with an upper surface of the sheet stacked on the stacking unit so that the moving unit can slip and move the sheet in a direction which crosses the sheet ejecting direction;

a driving unit which drives the moving unit, an aligning unit which receives a side edge along the sheet ejecting direction of the sheet which is moved in the crossing direction by the moving unit; and a movement blocking unit which blocks the movement of the sheet; and a controller which controls the movement blocking unit, wherein the controller controls the movement blocking unit to block the movement of the sheet until the driving unit drives by a predetermined amount when the driving unit moves the moving unit in the crossing direction.

* * * * *